US008201933B2

(12) United States Patent
Owaki et al.

(10) Patent No.: US 8,201,933 B2
(45) Date of Patent: Jun. 19, 2012

(54) LIQUID EJECTING HEAD AND LIQUID EJECTING APPARATUS

(75) Inventors: Hiroshige Owaki, Okaya (JP); Munehide Kanaya, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 556 days.

(21) Appl. No.: 12/394,180

(22) Filed: Feb. 27, 2009

(65) Prior Publication Data

US 2009/0219367 A1 Sep. 3, 2009

(30) Foreign Application Priority Data

Feb. 29, 2008 (JP) ..... 2008-051258

(51) Int. Cl.
*B41J 2/175* (2006.01)

(52) U.S. Cl. ..... 347/93

(58) Field of Classification Search ..... 347/86, 347/92, 93
See application file for complete search history.

(56) References Cited

U.S. PATENT DOCUMENTS

| | | | | |
|---|---|---|---|---|
| 5,546,109 | A * | 8/1996 | Nakano | 347/93 |
| 5,699,095 | A * | 12/1997 | Mitsuzawa et al. | 347/92 |
| 6,634,742 | B2 * | 10/2003 | Owaki et al. | 347/93 |
| 6,814,435 | B1 * | 11/2004 | Shimada et al. | 347/93 |
| 7,192,131 | B2 * | 3/2007 | Gao et al. | 347/93 |
| 7,448,741 | B2 * | 11/2008 | von Essen | 347/93 |
| 7,537,328 | B2 * | 5/2009 | Okubo | 347/93 |
| 7,690,777 | B2 * | 4/2010 | Wada | 347/93 |
| 7,775,652 | B2 | 8/2010 | Taira | |
| 2005/0030358 | A1 * | 2/2005 | Haines et al. | 347/93 |

FOREIGN PATENT DOCUMENTS

| | | |
|---|---|---|
| JP | 59-135110 | 9/1984 |
| JP | 06-099586 | 4/1994 |
| JP | 2000-211130 | 8/2000 |
| JP | 2004-106214 | 4/2004 |
| JP | 2007-160821 | 6/2007 |
| JP | 2007-160865 | 6/2007 |

* cited by examiner

*Primary Examiner* — Charlie Peng
(74) *Attorney, Agent, or Firm* — Workman Nydegger

(57) ABSTRACT

A liquid ejecting head includes a head body, a supply member having a first member, a second member, and a third member each having a liquid supply channel, the supply member including a first filter provided between the first member and the second member and a second filter provided between the second member and the third member; a first outer portion being provided between the first member and the second member, the first outer member being formed by integral molding for fixing the first member, the second member; a second outer portion being provided on the outer peripheries of the second member and the third member, the second outer portion being formed by integral molding for fixing the second member, the third member, and the second filter.

7 Claims, 8 Drawing Sheets

LIQUID EJECTING HEAD AND LIQUID EJECTING APPARATUS

BACKGROUND

1. Technical Field

The present invention relates to a liquid electing head configured to eject liquid and a liquid ejecting apparatus having the same and, specifically, an ink jet printhead configured to eject ink as the liquid and an ink jet printing apparatus.

2. Description of the Related Art

In an ink jet printhead as an representative example of a liquid ejecting head, generally, ink is supplied from an ink cartridge as a liquid storage unit in which ink is filled to a head body via ink supply needles as ink supply member detachably inserted into the ink cartridge and ink flow channels formed in a supply unit such as a cartridge case in which the ink cartridge is held, and the ink supplied to the head body is discharged from nozzles by driving a pressure generating unit such as a piezoelectric element provided in the head body.

The ink jet printhead as described above has a problem such that when air bubbles present in the ink in the ink cartridge or air bubbles mixed into the ink when mounting and demounting the ink cartridge are supplied to the head body, discharge failure such as missing dot might occur due to these air babbles. In order to solve the problem as described above, there is a printhead having filters for removing air bubbles or refuses in ink provided between the ink supply needles to be inserted into the ink cartridge and a supply unit (cartridge case) (for example, see JP-A-2000-211130).

Although the ink jet printhead as described above has already downsized in the related art, further downsizing is desired. However, in the configuration as described in JP-A-2000-211130, since a filter is provided in an area where the ink supply needle of the supply unit is fixed, the supply unit needs to have a size corresponding to the surface area of the filter, so that there arises a problem such that downsizing of the head is difficult.

For example, although downsizing the supply unit by reducing the distance between the ink supply needles is contemplated, since the area for welding the ink supply needles to the supply unit together with the filters is required, it is difficult to reduce the distance between the adjacent ink supply needles. Although downsizing of the surface area of the filters by themselves is contemplated for example, since the dynamic pressure is increased, there arises a problem that the drive pressure for driving the pressure generating unit such as the piezoelectric element must be increased. When the ink supply needles are fixed to the supply unit by heat adhesion, there is a risk of formation of a clearance between them, and hence there arises a problem such that ink might leak from this clearance. In addition, when the filters and the ink supply needles are fixed individually to the supply unit, there arises a problem such that the manufacturing cost is increased to a high cost.

Such problems are present also in a liquid ejecting head configured to eject liquid other than ink in addition to the ink jet printhead.

SUMMARY

An advantage of some aspects of the invention is to provide a liquid ejecting head and a liquid electing apparatus in which a head is downsized.

In order to solve the above-described problem, the invention provides a liquid ejecting head including: a head body having a plurality of nozzles for ejecting liquid; a supply unit having a first member, a second member, and a third member each having a liquid supply channel for supplying the liquid to the head body, the supply unit including a first filter provided between the first member and the second member and a second filter provided between the second member and the third member; a first outer portion being provided between the first member and the second member, the first outer member being formed by integral molding for fixing the first member, the second member, and the first filter in a state in which the first filter is clamped between the first member and the second member; a second outer portion being provided on the outer peripheries of the second member and the third member, the second outer portion being formed by integral molding for fixing the second member, the third member, and the second filter in a state in which the second filter is clamped between the second member and the third member; in which the first outer portion is provided around an area of the first filter being clamped between the first member and the second member, and the second outer portion is provided around an area of the second filter being clamped between the second member and the third member.

In this configuration, since the first and second filters are arranged on two different planes, the distance between the liquid supply channels may be shortened, so that downsizing of the head is achieved. In addition, by forming the first member, the second member, and the third member integrally with the first and second filters by the first and second outer portions, areas for welding the first member, the second member, the third member, and the respective filters to each other individually are not necessary, so that the effective surface area of the filters may be increased, thereby further reducing the distance between the liquid supply channels.

Preferably, the first outer portion and the second outer portion are integrally formed. Accordingly, the manufacturing process may be simplified and, since the respective spaces are connected, a resin material can be filled into these spaces desirably. Therefore, the first and second outer portions may be formed desirably.

Preferably, the first filter is provided so as to project to the outside the area being clamped between the first member and the second member, a part of the area of the first filter projecting to the outside the area being clamped between the first member and the second member is clamped by the first outer portion, and the second filter is provided so as to project to the outside the area being clamped between the second member and the third member, a part of the area of the second filter projecting to the outside the area being clamped between the second member and the third member is clamped by the second outer portion. Accordingly, the first and second filters are reliably held by the first and second outer portions, and the first and second filters are prevented from generation of kink or separation.

Preferably, the first filter and the second filter are formed with a plurality of penetrated portions, a portion of the first filter corresponding to the penetrated portion is clamped by the first outer portion, and a portion of the second filter corresponding to the penetrated portion is clamped by the second outer portion. Accordingly, when forming the first and second outer portions by integral molding, the first and second outer portions are reliably formed in a state in which the penetrated portions are penetrated therethrough. Therefore, the liquid supply channels may be reliably sealed, so that leakage of liquid or the like is prevented.

Preferably, the first outer portion and the second outer portion are present at different positions of the supply unit in plan view. Accordingly, the first and second outer portions may be provided in the proximity with the respective liquid supply channels, so that the liquid supply channels are sealed more reliably and leakage of liquid or the like is prevented.

Preferably, the liquid supply channel includes filter chambers having a wide flow channel provided respectively on both sides of the first and second filters, and the filter chambers in any flow channels have substantially the same shape. Accordingly, pressure loss or exhausting property in the respective filter chambers is substantially constant irrespective of the flow channels.

Preferably, the first and second filters are provided respectively over a plurality of the liquid flow channels continuously. Accordingly, the first and second filters are held further reliably between the respective members.

The invention also provides a liquid ejecting apparatus having the liquid ejecting head configured as described above. According to the embodiment of the invention, a compact liquid ejecting apparatus is achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail on the basis of embodiments.

Figure 1:
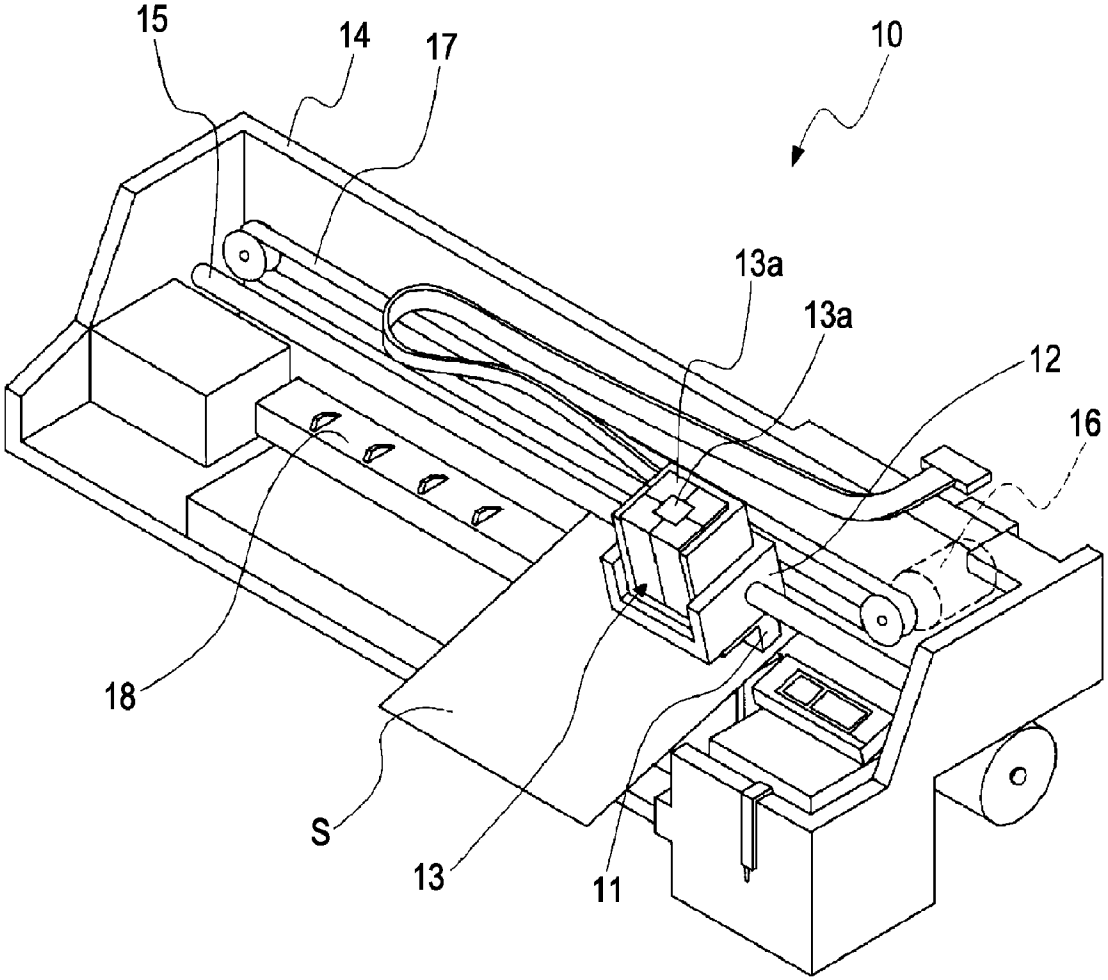
FIG. 1 is a schematic perspective view of a printing apparatus according to an embodiment of the invention.

FIG. 1 is a schematic perspective view of an ink jet printing apparatus according to a first embodiment of the invention. As shown in FIG. 1, an ink jet printing apparatus 10 as an example of a liquid ejecting apparatus in the invention is configured in such a manner that an ink jet printhead 11 as an example of a liquid ejecting head configured to discharge ink drops is fixed to a carriage 12, and the ink jet printhead 11 includes an ink cartridge 13 as liquid storing units in which ink in a plurality of different colors such as black (B), light black (LB), cyan (C), magenta (M), yellow (Y) and so on are stored detachably fixed thereto. The ink cartridge 13 includes a plurality of storage portions 13*a* for storing ink in respective colors and, for example, in this embodiment, four storage portions 13*a* are arranged around the storage portion 13*a* which is arranged at the center.

The carriage 12 having the ink jet printhead 11 mounted thereon is provided on a carriage shaft 15 attached to an apparatus body 14 so as to be movable in the axial direction. Then, with a drive force of a drive motor 16 transmitted to the carriage 12 via a plurality of gears and a timing belt 17, not shown, the carriage 12 is moved along the carriage shaft 15. On the other hand, the apparatus body 14 includes a platen 18 provided along the carriage shaft 15, and a printing medium S such as paper fed by a paper feed apparatus, not shown, is transported on the platen 18.

Figure 2:
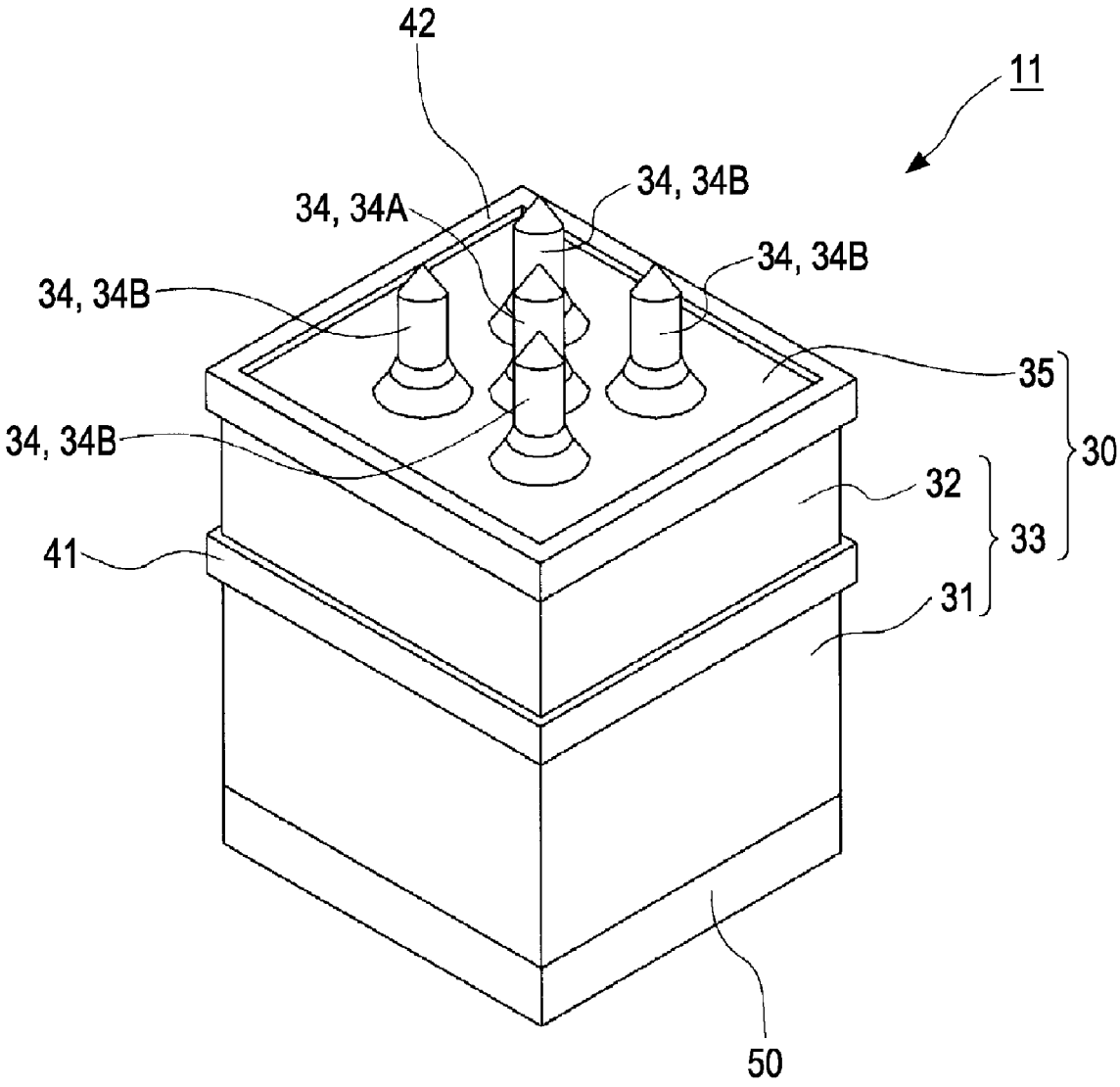
FIG. 2 is a schematic perspective view of a printhead according to the embodiment of the invention.
Figure 3:
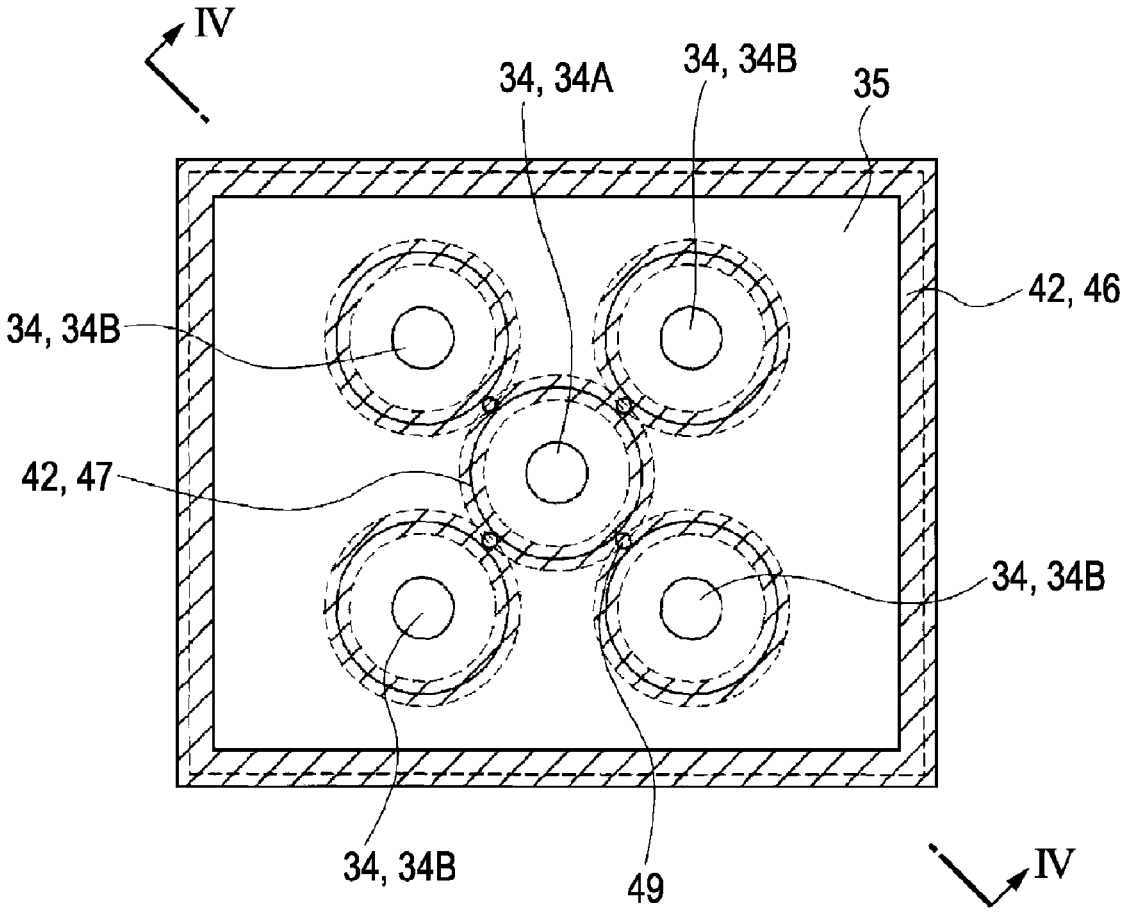
FIG. 3 is a top view of the printhead according to the embodiment of the invention.
Figure 4:
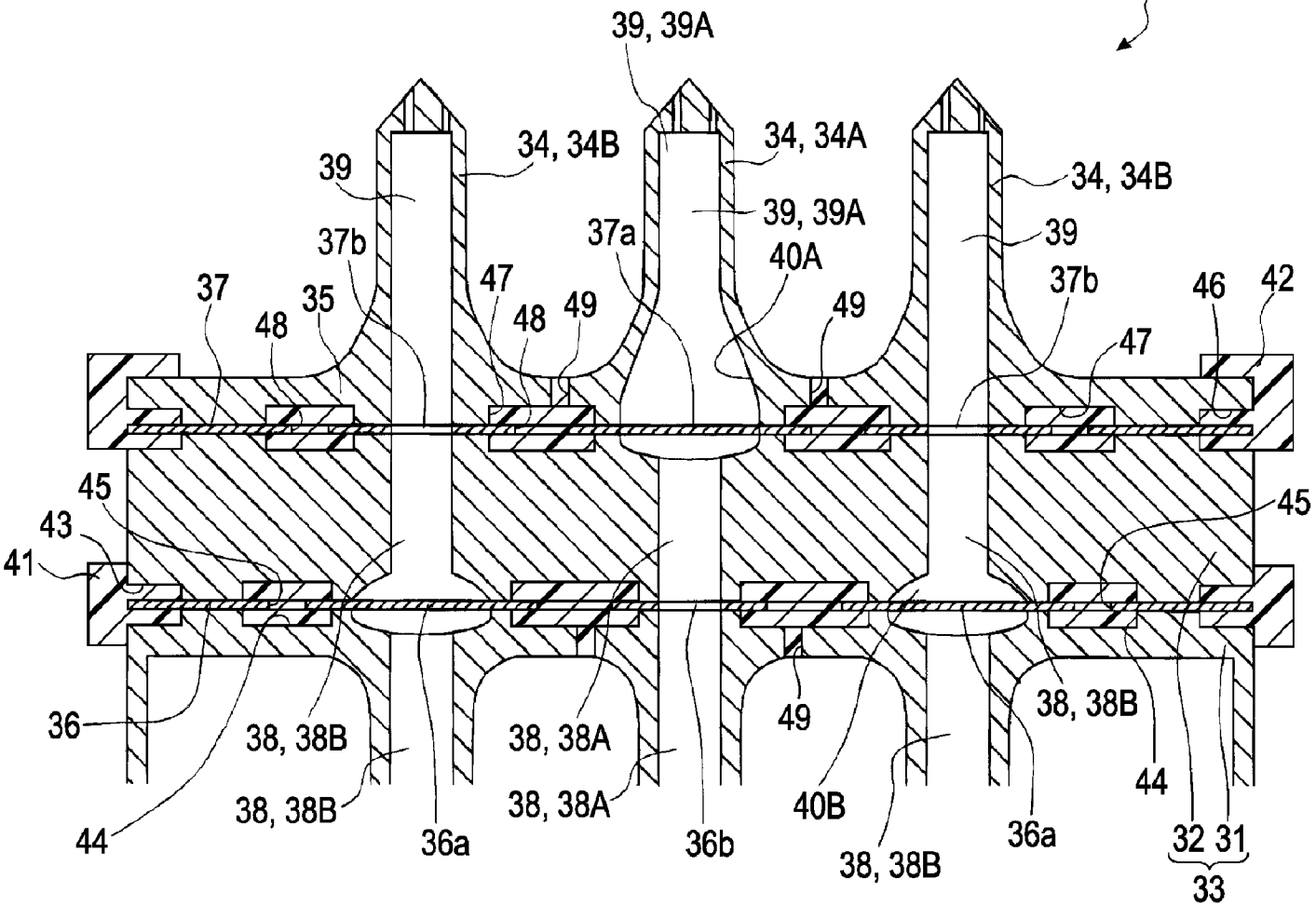
FIG. 4 is a cross-sectional view showing a principal portion of a supply unit according to the embodiment of the invention.
Figure 5A:
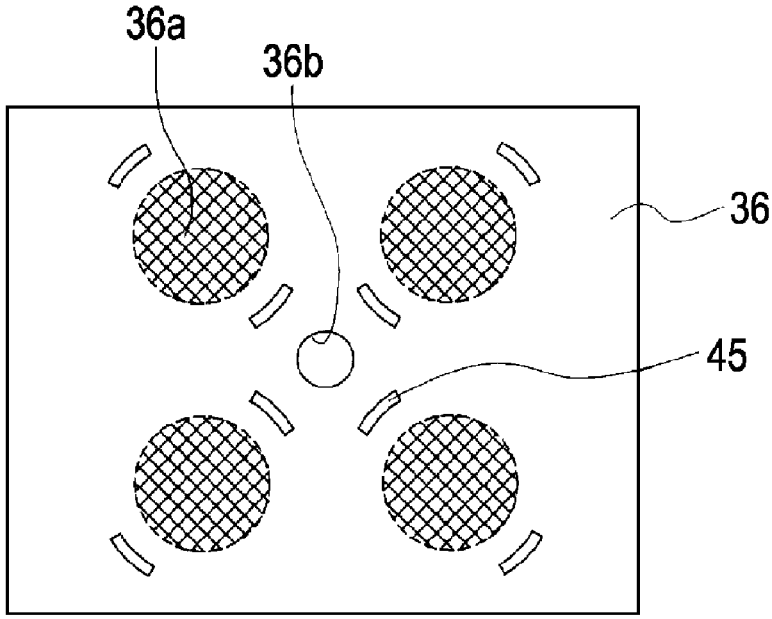
FIG. 5A is a plan view showing a first filter according to the embodiment of the invention.
Figure 5B:
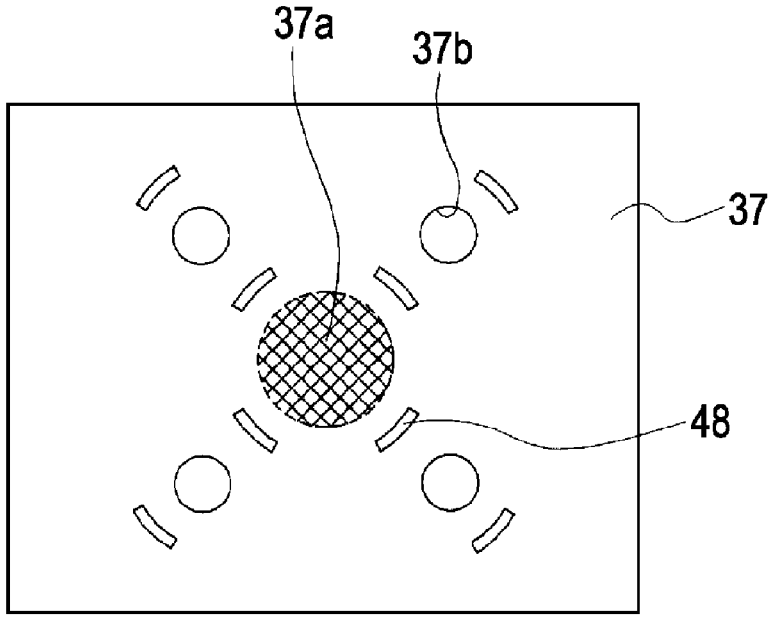
FIG. 5B is a plan view showing a second filter according to the embodiment of the invention.

The ink jet printhead 11 according to this embodiment will be described. FIG. 2 is a schematic perspective view of the ink jet printhead as an example of the liquid ejecting head according to this embodiment. FIG. 3 is a rough sketch of a top view of the ink jet printhead, and FIG. 4 is a cross-sectional view of a principal portion of a supply unit taken along the line IV-IV in FIG. 3. FIG. 5A is a plan view of a first filter. FIG. 5B is a plan view of a second filter.

As shown in FIG. 2 to FIG. 5, the printhead 11 includes a supply unit 30 having flow channels for receiving the supply of ink from the ink cartridge 13 as the liquid storage unit, and a head body 50 fixed to a surface opposite from the ink cartridge 13 of the supply unit 30.

The supply unit 30 includes, for example, a cartridge case 33 having a first member 31 and a second member 32, a supply member 35 as a third member being provided on one of the surface of the cartridge case 33 (second member 32) and integrally having a plurality of ink supply needles 34, a first filter 36 disposed between the first member 31 and the second member 32 which constitute the cartridge case 33, and a second filter 37 disposed between the cartridge case 33 and the supply member 35.

The cartridge case 33 includes a plurality of split members, in this embodiment, two split members composed of the first member 31 and the second member 32 described above, and the first member 31 and the second member 32 are fixed thereto. The supply member 35 is fixed to the second member 32, and the head body 50 is fixed to the first member 31. The cartridge case 33 is provided with a plurality of ink supply channels 38 opening at one end to a surface on the side of the supply member 35 and at the other end to a surface on the side of the head body 50 for supplying ink from the ink cartridge 13 to the head body 50. In other words, the respective ink supply channels 38 are provided through the first member 31 and the second member 32 independently corresponding to the ink in respective colors.

The supply member 35 integrally includes a plurality of (five) the ink supply needles 34 which are inserted respectively into the storage portions 13*a* of the ink cartridge 13 in which the ink in respective colors are stored. The ink supply needles 34 each are formed with a through channel 39 and the storage portions 13*a* of the ink cartridge 13 and the ink supply channels 38 are connected via the through channels 39 respectively.

The first filter 36 is clamped between the first member 31 and the second member 32, and includes filter portions 36*a* arranged at positions corresponding to the predetermined ink supply channels 38 for removing air bubbles or foreign substances in the ink in the ink supply channels 38. For example, in this embodiment, the first filter 36 is provided with a through hole 36*b* at a position corresponding to an ink supply channel 38A which communicates with an ink supply needle 34A provided at the center portion of the supply member 35 and filter portions 36*a* at positions corresponding respectively to ink supply channels 38B arranged around the ink supply needle 34A (see FIG. 5A).

The second filter 37 is clamped between the second member 32 which constitutes the cartridge case 33 and the supply member 35, and includes a filter portion 37*a* arranged at a position corresponding to the predetermined ink supply channel 38 for removing air bubbles or foreign substances in the ink in the ink supply channel 38. For example, in this embodiment, in contrast to the first filter 36, the filter portion 37*a* is provided at a position corresponding to the ink supply channel 38A which communicates with the ink supply needle 34A arranged at the center of the supply member 35, and through holes 37*b* are formed respectively at positions corresponding to the ink supply channels 38B which communicate with ink supply needles 34B arranged around the ink supply needle 34A (see FIG. 5B).

In other words, according to the embodiment of the invention, the respective filter portions 36*a* and 37*a* for removing air bubbles or foreign substances in the ink are not provided on the same plane, but on two different planes, in this embodiment, the filter portions 36*a* and 37*a* are provided at joints between the first member 31 and the second member 32 which constitute the cartridge case 33 and at a joint between the cartridge case 33 and the supply member 35.

By providing the filter portions 36*a* and 37*a* on the different planes, the distance between the filter portions 36*a* and 37*a* provided on the different planes may be reduced, so that downsizing of the supply unit 30 is achieved. Also, downsizing of the printhead 11 as a whole is achieved in association with the downsizing of the supply unit 30. Furthermore, while achieving the downsizing of the supply unit 30, the surface areas of the filter portions 36*a* and 37*a* may be increased to reduce the dynamic pressure, thereby reducing a voltage for driving a pressure generating unit provided on the head body 50.

At a joint between a through channel 39A of the ink supply needle 34A and the ink supply channel 38A of the second member 32, a filter chamber 40A which is larger in inner diameter than other areas (having wider flow channel) is formed, and the filter portion 37*a* of the second filter 37 is arranged in the filter chamber 40A. The filter chamber 40A is formed, for example, to increase in inner diameter as it goes toward the second filter 37 in this embodiment. Also, filter chambers 40B may be formed at joints between the ink supply channels 38B of the first member 31 and the ink supply channels 38B of the second member 32, and the filter portions 36*a* of the first filter 36 are arranged in the filter chambers 40B. These filter chambers 40A and 40B are provided for securing the surface areas of the respective filter portions 37*a* and 36*a* and minimizing the resistance generated when ink passes therethrough.

In this embodiment, although the filter chamber 40A provided at a joint between the ink supply needle 34A and the second member 32 and the filter chambers 40B provided at the joints between the first member 31 and the second member 32 have different shapes, they are preferably formed into the substantially same shape. Accordingly, pressure loss or exhausting property in the filter chambers 40A and 40B of the ink supply channels 38A and 38B may be almost constant, so that the ink supply properties are uniformized and ink drop ejecting characteristics are uniformized.

The first member 31 and the second member 32 which constitutes the cartridge case 33 are fixed by a first outer portion 41 provided at the joint between the first member 31 and the second member 32 in a state of clamping the first filter 36. In other words, the first member 31, the second member 32, and the first filter 36 are integrally fixed by the first outer portion 41. The second member 32 which constitutes the cartridge case 33 and the supply member 35 are fixed by a second outer portion 42 provided at the joint between the second member 32 and the supply member 35 in a state of clamping the second filter 37. In other words, the second filter 37 is integrally fixed by the second outer portion 42 together with the second member 32 and the supply member 35.

More specifically, a space portion 43 formed of a groove portions formed respectively on the first member 31 and the second member 32 is formed along the outer periphery of the joint between the first member 31 and the second member 32, and the first filter 36 has a size projecting into the space portion 43. In this embodiment, space portions 44 are provided not only along the outer periphery of the joint between the first member 31 and the second member 32, but also around the respective ink supply channels 38. The first filter 36 positioned in these space portions 44 is provided with a plurality of penetrated portions 45 in the circumferential direction of the ink supply channels 38 (see FIG. 5A). Then, the first member 31 and the second member 32 are integrally fixed with the first filter 36 by the first outer portion 41 formed of resin material provided in the space portions 43 and 44. In other words, the first outer portion 41 is provided along the peripheral edge of the area of the first filter 36 clamped by the first member 31 and the second member 32, and the first member 31 and the second member 32 are integrally fixed with the first filter 36.

A space portion 46 is also formed along the outer peripheral of the joint between the second member 32 an the supply member 35, and the second filter 37 has a size projecting into the space portion 46. In this embodiment, space portions 47 are provided not only along the outer periphery of the joint between the second member 32 and the supply member 35, but also around the respective ink supply channels 38 (see FIG. 3). The second filter 37 positioned in these space portions 47 is provided with a plurality of penetrated portions 48 in the circumferential direction of the ink supply channels 38 (see FIG. 5B). Then, the second member 32 and the supply member 35 are integrally fixed with the second filter 37 by the second outer portion 42 formed of resin material provided in the space portions 46 and 47. In other words, the second outer portion 42 is provided along the peripheral edge of the area of the second filter 37 clamped by the second member 32 and the supply member 35, and the second member 32 and the supply member 35 are integrally fixed with the second filter 37.

The first outer portion 41 as described above is formed by molding integrally with the first member 31, the second member 32, and the first filter 36. In the same manner, the second outer portion 42 is also formed by molding integrally with the second member 32, the supply member 35, and the second filter 37. The supply member 35 and the first member 31 are formed with filling ports 49 which communicate with the space portions 44 and 47 provided around the respective ink supply channels 38, and the first and second outer portions 41 and 42 are formed by filling resin material into the space portions 44 and 47 around the respective ink supply channels 38 via these filling port 49.

As described thus far, with the configuration according to the embodiment of the invention, since the cartridge case 33 including the first and second members 31 and 32, the supply member 35, and the first and second filters 36 and 37 are integrated by the first and second outer portions 41 and 42 formed by molding integrally, areas for welding the supply member 35 or the first and second filters 36 and 37 are no longer necessary, so that downsizing of the head is achieved by further shortening the distance between the respective ink supply channels 38. Since the desired surface areas of the respective filter portions 36*a* and 37*a* may be secured even though the head is downsized, increase in dynamic pressure is also restrained.

In addition, since the second member 32 and the first filter 36 may be fixed simultaneously to the first member 31 by the first outer portion 41, and the second filter 37 and the supply member 35 may be fixed simultaneously to the second member 32 by the second outer portion 42, reduction of cost is achieved by simplifying the manufacturing process.

Since the first member 31 and the second member 32 which constitute the cartridge case 33 are fixed by the first outer portion 41 and the cartridge case 33 and the supply member 35 are fixed by the second outer portion 42, formation of a clearance between these two members is prevented, so that leakage of ink in the ink supply channels 38 from the clearance to the outside is prevented.

The first outer portion 41 and the second outer portion 42 are preferably present at different positions of the supply unit 30 in plan view. In other words, the space portions 44 formed between the first member 31 and the second member 32 and the space portion 47 provided between the supply member 35 and the second member 32 are preferably present at different positions in plan view of the supply unit 30. Accordingly, the ink supply channels 38 are reliably sealed tightly, and leakage of the ink in the ink supply channels 38 to the outside is prevented more reliably.

Figure 6:
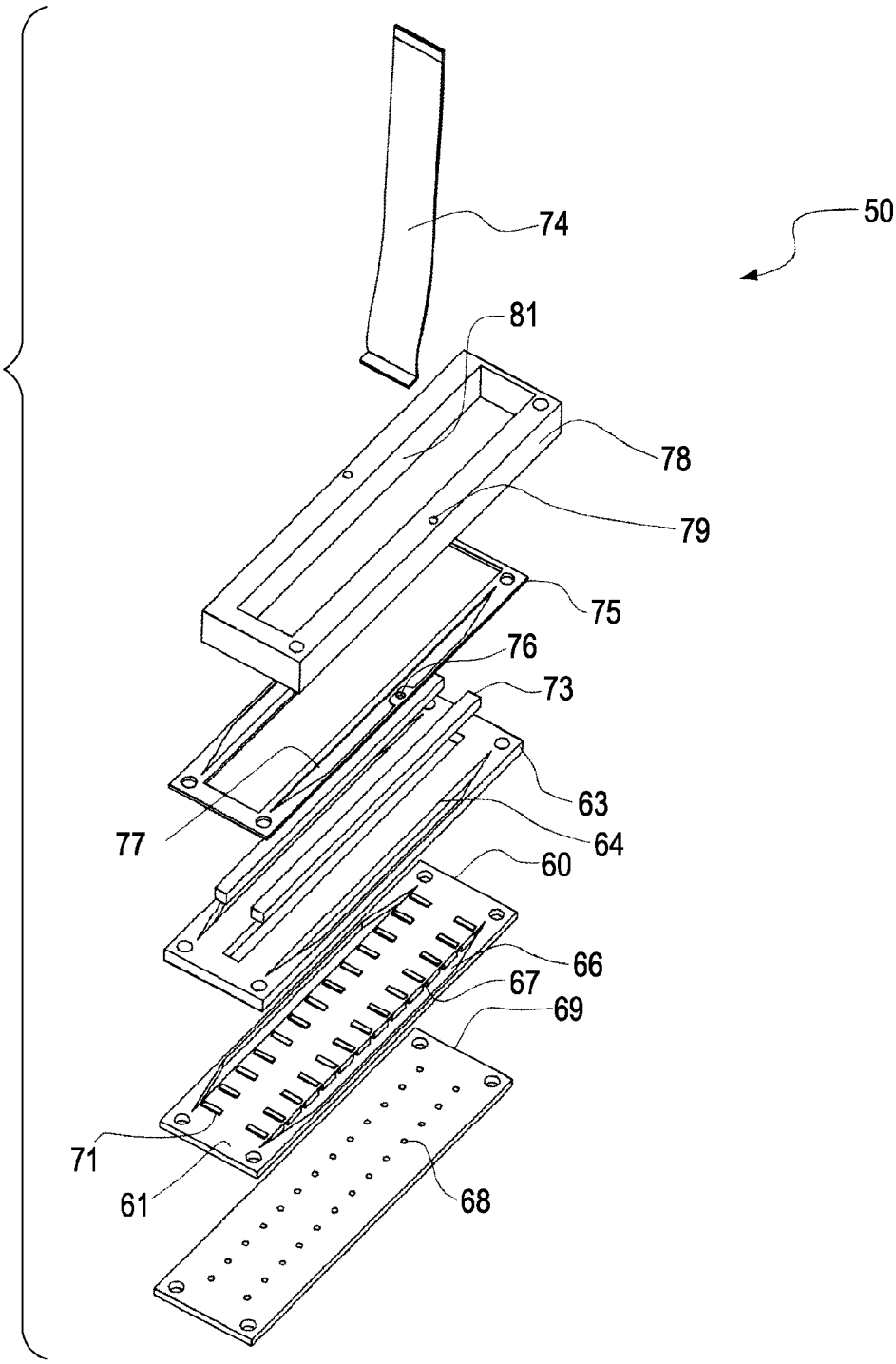
FIG. 6 is an exploded perspective view of a head body according to the embodiment of the invention.
Figure 7:
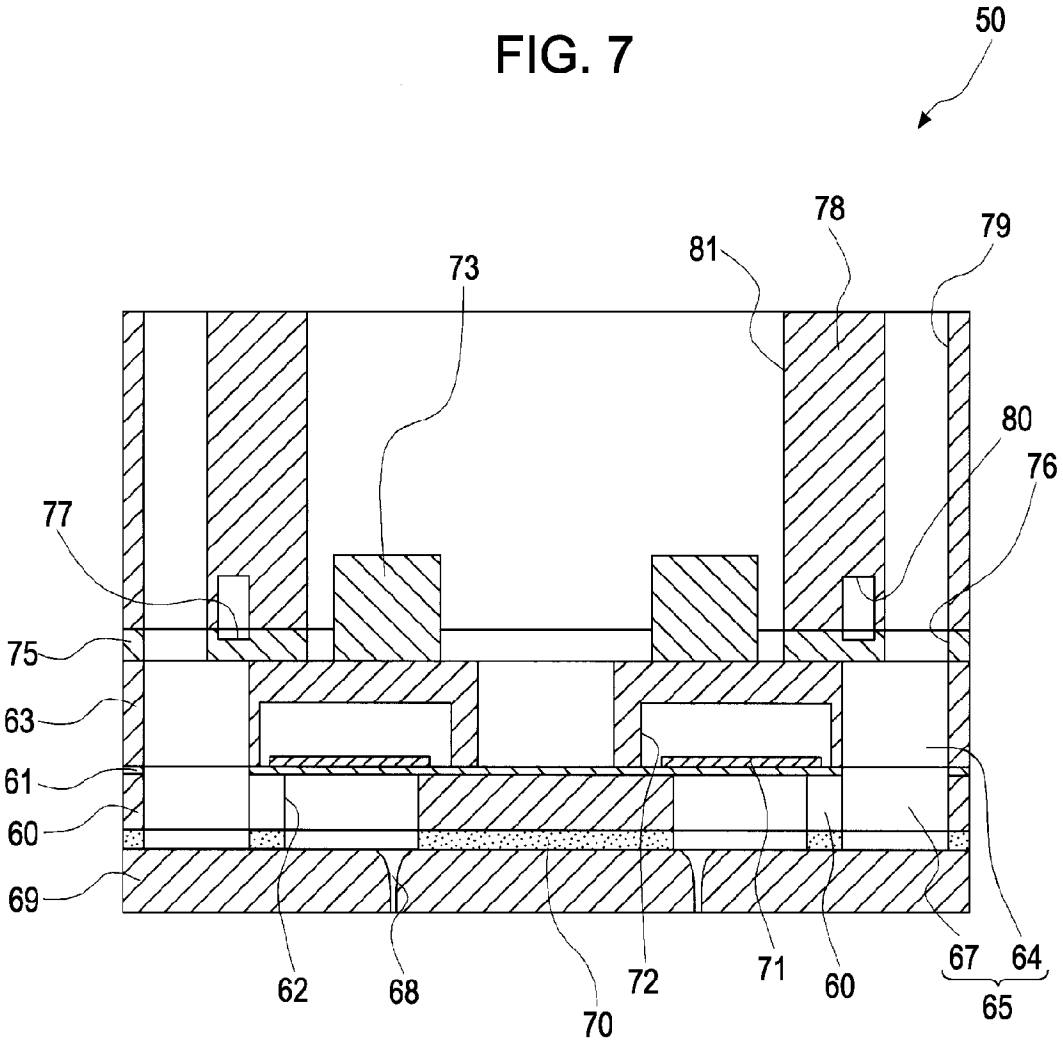
FIG. 7 is a cross-sectional view showing the head body according to the embodiment of the invention.

A head body 50 is provided on the supply unit 30 on the other side from the ink supply channels 38, that is, on the opposite side from the supply member 35. Here, an example of the head body 50 will be described. FIG. 6 is an exploded perspective view of a head body, and FIG. 7 is a cross-sectional view of the head body.

As shown in the drawing, a flow channel formed substrate 60 which constitutes the head body 50 is formed of a silicon monocrystal substrate, and one surface thereof is formed with a resilient film 61 formed of silicon dioxide in this embodiment. The flow channel formed substrate 60 is formed with pressure generating chambers 62 sectionalized by a plurality of partitions arranged in two rows in parallel in the widthwise direction by the anisotropic etching from the side of the other surface. Also, formed on the outsides of the pressure generating chambers 62 in the respective rows in the longitudinal direction are communicating portions 66 which communicate with reservoir portions 64 provided on a reservoir forming substrate 63, and constitute reservoirs 65 which serve as common ink chambers for the respective pressure generating chambers 62. The communicating portions 66 are respectively in communication with one end portions of the respective pressure generating chambers 62 in the longitudinal directions via ink supply channels 67. In other words, in this embodiment, the pressure generating chambers 62, the communicating portions 66, and the ink supply channel 67 are provided as liquid flow channel formed on the flow channel formed substrate 60.

A nozzle plate 69 formed with nozzle openings 68 is fixed to the flow channel formed substrate 60 on the side of the opening surface with an adhesive agent 70. The nozzle openings 68 of the nozzle plate 69 are formed at positions to communicate with the ink supply channels 67 of the respective pressure generating chambers 62 on the opposite side. In this example, since the two rows of the pressure generating chambers 62 are formed in parallel on the flow channel formed substrate 60, two rows of nozzles including the nozzle openings 68 are formed in parallel in the each head body 50. As such the nozzle plate 69, for example, metallic substrate such as a silicon monocrystal substrate or a stainless steel (SUS) is applicable.

In contrast, formed on the elastic film 61 on the opposite side of the flow channel formed substrate 60 from the opening surface are piezoelectric elements 71 formed by laminating a lower electrode film formed of metal, a piezoelectric member layer formed of piezoelectric material such as lead-zirconate-titanate (PZT), and an upper electrode film formed of metal in sequence.

On the flow channel formed substrate 60 formed with the piezoelectric elements 71 as described above, the reservoir forming substrate 63 having the reservoir portions 64 which constitute at least part of the reservoirs 65 is joined. The reservoir portions 64 are formed, for example, across the widthwise direction of the pressure generating chambers 62 so as to penetrate through the reservoir forming substrate 63 in the thickness direction, and are in communication with the communicating portions 66 of the flow channel formed substrate 60 as described above to form the reservoirs 65 which serve as the common ink chambers for the respective pressure generating chambers 62.

Provided in areas opposing the piezoelectric elements 71 of the reservoir forming substrate 63 are piezoelectric element holding portions 72 each having a space which does not impair the movement of the piezoelectric elements 71.

Furthermore, provided on the reservoir forming substrate 63 are drive circuits 73 each including a semiconductor integrated circuit (IC) for driving the respective piezoelectric elements 71. Respective terminals of the drive circuit 73 are connected to lead lines drawn from individual electrodes of the respective piezoelectric elements 71 via bonding wires or the like, not shown. Then, the respective terminals of the drive circuit 73 are connected to the outside via an external wiring 74 such as a flexible print circuit (FPC) so as to receive various signals such as print signals via the external wiring 74 from the outside.

A compliance substrate 75 is joined onto the reservoir forming substrate 63 in this configuration. Ink introduction ports 76 for supplying ink into the reservoirs 65 are formed in areas opposing the reservoirs 65 on the compliance substrate 75 by being penetrated through in the thickness direction. The area of the compliance substrate 75 opposing the reservoirs 65 other than the ink introduction ports 76 is flexible portion 77 formed to be thin in the thickness direction, and the reservoirs 65 are sealed by the flexible portion 77. The flexible portion 77 provides compliance to the interior of the reservoirs 65.

A head case 78 is fixed to the compliance substrate 75. The head case 78 is formed with ink supply communication channels 79 which are in communication with the ink introduction ports 76 and also in communication with the ink supply channels 38 of the supply unit 30 for supplying ink from the supply unit 30 to the ink introduction ports 76. This head case 78 is formed with a groove portion 80 in an area opposing the flexible portion 77 of the compliance substrate 75, so as to allow bending deformation of the flexible portion 77 as appropriate. The head case 78 is provided with a drive circuit holding portion 81 penetrated in the thickness direction in an area opposing the drive circuit 73 provided on the reservoir forming substrate 63 and the external wiring 74 is passed through the drive circuit holding portion 81 and is connected to the drive circuit 73.

The head body 50 in this configuration takes ink from the ink cartridge 13 from the ink supply channels 38 via the ink supply communication channels 79 and the ink introduction ports 76, then fills the interior from the reservoirs 65 to the nozzle openings 68 with ink, and then applies a voltage to the respective piezoelectric elements 71 corresponding to the respective pressure generating chambers 62 according to the print signal from the drive circuit 73 to cause the piezoelectric elements 71 to bend and deform, so that the pressure in the interiors the respective pressure generating chambers 62 rises, and ink drops are discharged from the nozzle openings 68.

Although an embodiment of the invention has been described thus far, the invention is not limited to this embodiment.

Figure 8:
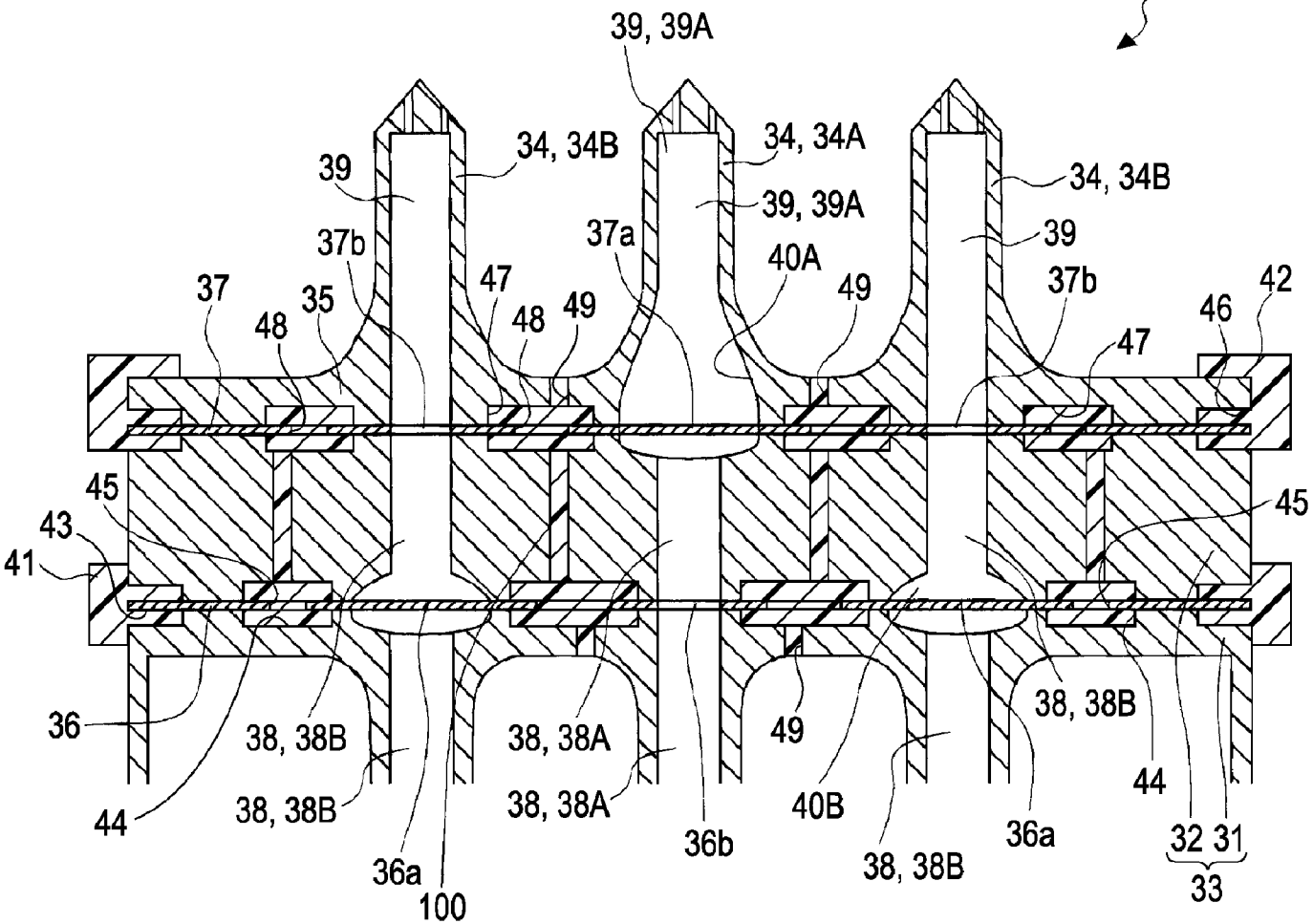
FIG. 8 is a cross-sectional view showing a modification of the supply unit according to the embodiment of the invention.

For example, the first outer portion 41 and the second outer portion 42 are provided completely independently in the above-described embodiment. In other words, the first outer portion 41 and the second outer portion 42 are molded separately. However, as shown in FIG. 8 for example, a configuration in which space communication portions 100 which communicate the space portions 44 provided at the joint between the first member 31 and the second member 32 and the space portion 47 provided at the joint between the supply member 35 and the second member 32 is provided on the second member 32, and the first outer portion 41 and the second outer portion 42 are molded simultaneously and substantially integrally is also applicable. By providing the space communication portions 100 and molding at once, the resin material is reliably filled in the respective space portions 44 and 47 and the resin material is filled in the respective space portions 44 and 47 further reliably, so that the first and second outer portions 41 and 42 are formed desirably.

In the above-described embodiment, the first filter and the second filter each are formed to have a size which makes the peripheral edge thereof project into the space portions. However, the invention is not limited thereto, the first filter and the second filter each may have a size which does not make the peripheral edge thereof project into the space portion, and the first filter and the second filter may be clamped by the supply member and the first and second members which constitute the cartridge case. In this configuration, good fixation of the respective members is achieved as a matter of course. In addition, although a plurality of filter portions are formed integrally with the second filter, the respective filters may also be independent, as a matter of course.

In the above-described embodiment, the plurality of ink supply needles 34 are integrally provided on the supply member 35. However, the invention is not limited thereto, and the respective ink supply needles 34 may be provided independently. In this case, the respective ink supply needles correspond to the supply members.

In the above-described embodiment, the ink jet printhead 11 having the plurality of ink supply needles 34 has been exemplified. However, the arrangement of the plurality of ink supply needles is not specifically limited and, for example, they may be aligned in one row in parallel to each other.

In the above-described embodiment, the configuration in which the ink cartridges 13 as the liquid storage units are demountable with respect to the cartridge case 33 has been described. However, the invention is not limited thereto and, for example, a configuration in which an ink tank or the like is provided at a position different from the printhead 11 as the liquid storage unit, and the liquid storage unit and the printhead 11 are connected via supply pipe such as a tube is also applicable. In other words, although the configuration in which the needle-like ink supply needles 34 are provided as the supply members has been exemplified in the above-described embodiment, the supply members (ink supply needles) are not limited to be the needle-like members.

In the above-described embodiment, the configuration in which the one head body 50 is provided for the plurality of the ink supply channels 38 has been exemplified. However, a plurality of the head bodies may be provided for each colors of ink. In such a case, the respective ink supply channels may be provided so as to be in communication with the respective head bodies, that is, the respective ink supply channels may be provided so as to be in communication with each nozzle rows having the nozzle openings arranged in parallel on the respective head bodies. As a matter of course, the ink supply channels may not be in communication with the respective rows of nozzles, it is applicable to bring one ink supply channel into communication with the plurality of nozzle rows or, alternatively, it is also applicable to divide one row of nozzles into two and bring the ink supply channel into communication with the respective groups of nozzles. In other words, what is essential is that the ink supply channel is in communication with the nozzle opening group including a plurality of the nozzle openings.

In the above-described embodiment, the ink jet printhead 11 which discharges ink drops has been exemplified for describing the invention. However, the invention is intended to be applied widely and generally to liquid ejecting heads. The liquid ejecting head includes, for example, a printhead used in an image printing apparatus such as a printer, a color material ejecting head used for manufacturing a color filter such as a liquid crystal display, an electrode material ejecting head used for forming electrodes of an organic EL display or an FED (Field Emission Display), or a biological organic ejecting head used for manufacturing biochips.

The entire disclosure of Japanese Patent Application No. 2008-051258, filed Feb. 29, 2008 is incorporated by reference herein.

What is claimed is:

1. A liquid ejecting head comprising:

a head body having a plurality of nozzles for ejecting liquid;

a supply unit having a first member, a second member, and a third member each having a liquid supply channel for supplying the liquid to the head body, the supply unit including a first filter provided between the first member and the second member and a second filter provided between the second member and the third member;

a first outer portion being provided between the first member and the second member, the first outer portion being formed by integral molding for fixing the first member, the second member, and the first filter in a state in which the first filter is clamped between the first member and the second member;

a second outer portion being provided on the outer peripheries of the second member and the third member, the second outer portion being formed by integral molding for fixing the second member, the third member, and the second filter in a state in which the second filter is clamped between the second member and the third member;

wherein the first outer portion is provided around an area of the first filter being clamped between the first member and the second member, and the second outer portion is provided around an area of the second filter being clamped between the second member and the third member, wherein the first filter is provided so as to project to the outside the area being clamped between the first member and the second member, a part of the area of the first filter projecting to the outside the area being clamped between the first member and the second member is clamped by the first outer portion, and the second filter is provided so as to project to the outside the area being clamped between the second member and the third member, a part of the area of the second filter projecting to the outside the area being clamped between the second member and the third member is clamped by the second outer portion.

2. The liquid ejecting head according to claim 1, wherein the first outer portion and the second outer portion are integrally formed.

3. The liquid ejecting head according to claim 1, wherein the first filter and the second filter are formed with a plurality of penetrated portions, a portion of the first filter corresponding to the penetrated portion is clamped by the first outer portion, and a portion of the second filter corresponding to the penetrated portion is clamped by the second outer portion.

4. The liquid ejecting head according to claim 1, wherein the first outer portion and the second outer portion are present at different positions of the supply unit in plan view.

5. The liquid ejecting head according to claim 1, wherein the liquid supply channel includes filter chambers having a wide flow channel provided respectively on both sides of the first and second filters, and the filter chambers in any flow channels have substantially the same shape.

6. The liquid ejecting head according to claim 1, wherein the first and second filters are provided respectively over a plurality of the liquid flow channels continuously.

7. A liquid ejecting apparatus comprising the liquid ejecting head according to claim 1.

* * * * *